United States Patent [19]

Pursnani et al.

[11] 4,045,635

[45] Aug. 30, 1977

[54] ELECTRICAL SWITCH CONSTRUCTION AND IMPROVED OVERTRAVEL SWITCH BLADE THEREFOR AND METHOD OF MAKING THE SAME

[75] Inventors: Khiman K. Pursnani, Milford; Roger P. Sepso, Stratford, both of Conn.

[73] Assignee: Robertshaw Controls Company, Richmond, Va.

[21] Appl. No.: 651,225

[22] Filed: Jan. 22, 1976

[51] Int. Cl.[2] ..... H01H 1/26

[52] U.S. Cl. ..... 200/283; 29/622; 29/630 R; 200/288

[58] Field of Search ..... 200/1 A, 283, 288, 159 A, 200/67 D, 83 P; 29/622, 630 R

[56] References Cited

U.S. PATENT DOCUMENTS

| | | | |
|---|---|---|---|
| 2,335,110 | 11/1943 | Dann | 200/1 A |
| 2,825,780 | 4/1958 | Beller et al. | 200/288 |
| 2,847,542 | 8/1958 | Ritter | 200/283 |
| 3,018,353 | 1/1962 | Mitchell | 200/283 |

FOREIGN PATENT DOCUMENTS

| | | | |
|---|---|---|---|
| 995,933 | 6/1965 | United Kingdom | 200/288 |

*Primary Examiner*—David Smith, Jr.
*Attorney, Agent, or Firm*—Candor, Candor & Tassone

[57] ABSTRACT

An electrical switch construction having a housing provided with an acutuator for causing movement of a movable switch blade relative to an overtravel compensating fixed switch blade, the fixed switch blade being secured to a rigid terminal carried by the housing and having an extension thereof that is disposed in the path of movement of the fixed switch blade to limit movement thereof in one direction.

18 Claims, 11 Drawing Figures

ELECTRICAL SWITCH CONSTRUCTION AND IMPROVED OVERTRAVEL SWITCH BLADE THEREFOR AND METHOD OF MAKING THE SAME

This invention relates to an improved electrical switch construction as well as to an improved overtravel compensating fixed switch blade therefor and method of making the same.

It is well known that control devices have been provided wherein each has a movable blade of an electrical switch construction thereof moved relative to a fixed switch blade by an actuator in response to sensed conditions, the fixed switch blade having means for compensating for overtravel movement of the movable blade against the same in one direction.

It is a feature of this invention to provide such an electrical switch construction having an improved overtravel compensating fixed switch blade.

In particular, one embodiment of this invention provides an electrical switch construction having a housing provided with an actuator for causing movement of a movable switch blade relative to an overtravel compensating fixed switch blade. A rigid terminal is carried by the housing and is secured to the fixed switch blade, the terminal having an extension thereof that is disposed in the path of movement of the fixed switch blade to limit movement thereof in one direction.

Accordingly, it is an object of this invention to provide an improved electrical switch construction having one or more of the novel features set forth above or hereinafter shown or described.

Another object of this invention is to provide an improved overtravel compensating fixed switch blade having one or more of the novel features set forth above or hereinafter shown or described.

Another object of this invention is to provide an improved method for making an overtravel compensating fixed switch blade, the method of this invention having one or more of the novel features set forth above or hereinafter shown or described.

Other objects, uses and advantages of this invention are apparent from a reading of this description which proceeds with reference to the accompanying drawings forming a part thereof and wherein.

Figure 1:
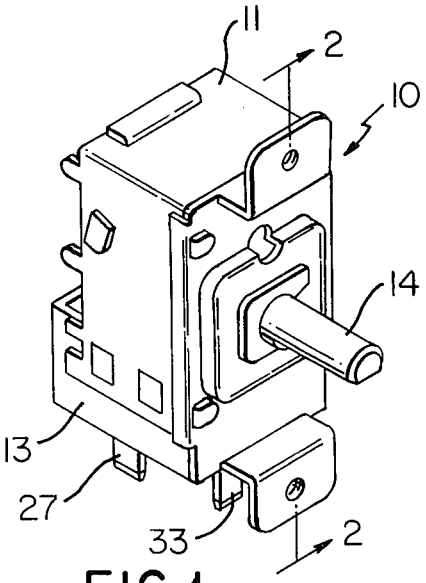
FIG. 1 is a perspective view of the improved control device of this invention.

While the various features of this invention are hereinafter illustrated and described as being particularly adapted to provide an electrical switch construction that is condition responsive, it is to be understood that the various features of this invention can provide an electrical switch construction that can be operated by any desired means.

Therefore, this invention is not to be limited to only the embodiments illustrated in the drawings, because the drawings are merely utilized to illustrate one of the wide variety of uses of this invention.

Figure 3:
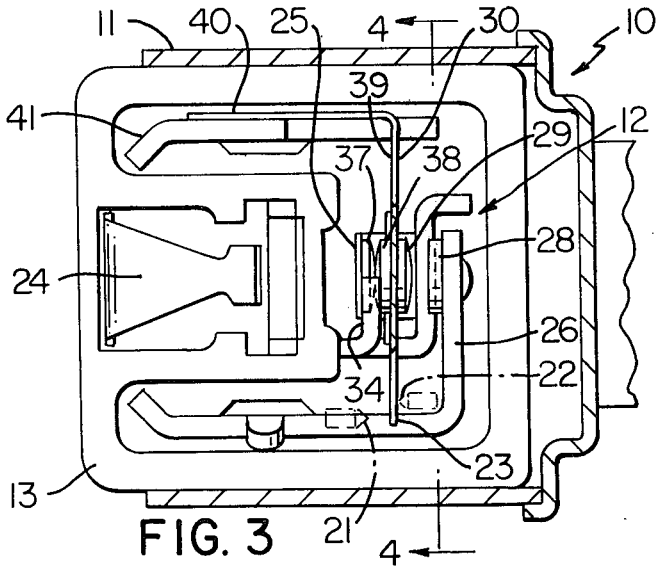
FIG. 3 is a cross-sectional view taken on line 3—3 of FIG. 2.
Figure 2:
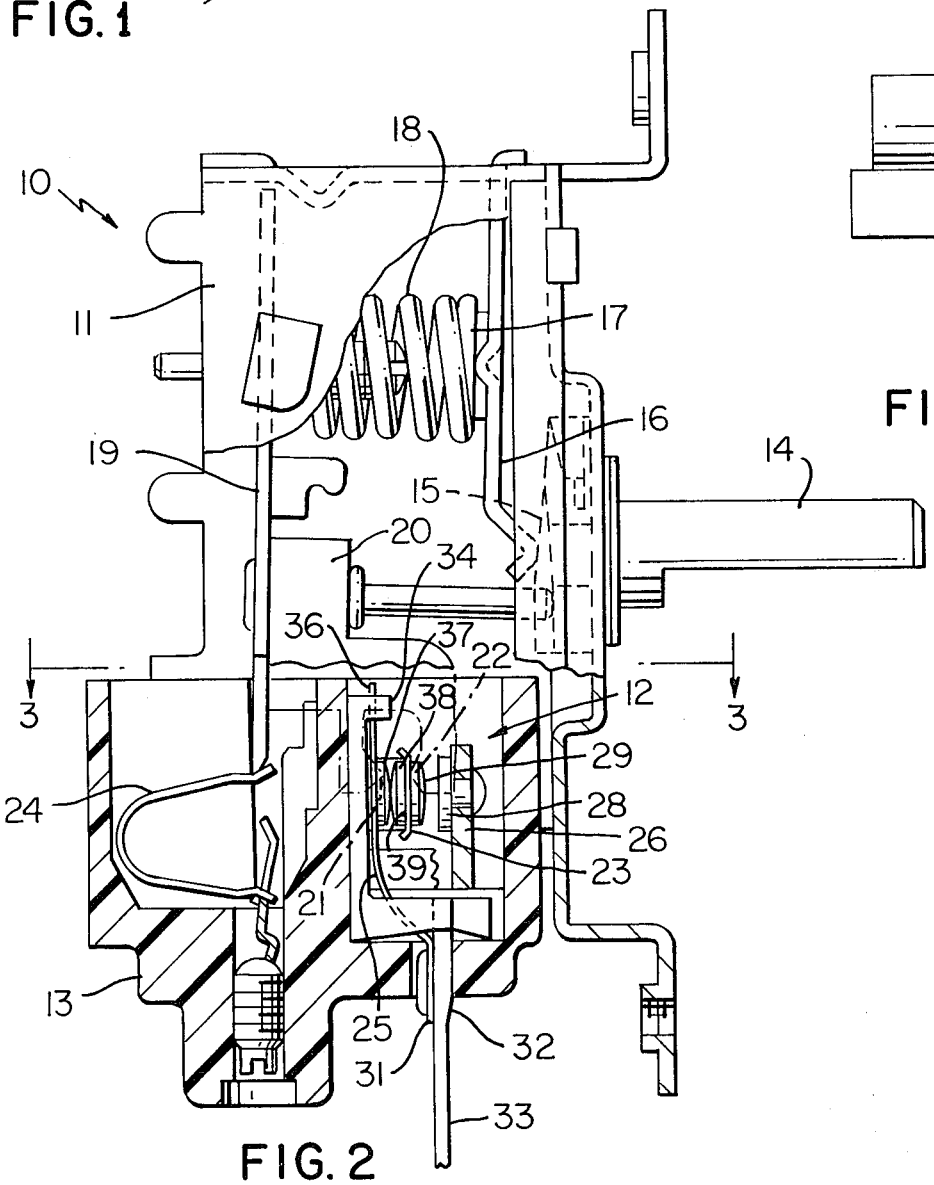
FIG. 2 is an enlarged cross-sectional view taken substantially on line 2—2 of FIG. 1.
Figure 2A:
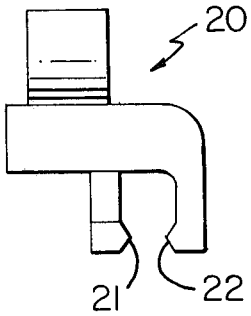
FIG. 2A is a side view of the actuator for the electrical switch construction of the control device of FIG. 2.

As illustrated in FIGS. 1, 2, and 3, a control device is generally indicated by the reference numeral 10 and comprises a housing means 11 that contains an electrical switch construction of this invention that is generally indicated by the reference numeral 12 in FIG. 2 and includes its own housing means 13 fastened to the control device housing means 11 in any suitable manner.

The control device 10 includes a control shaft 14 rotatably mounted to the housing means 11 and having a cam portion 15 for setting the position of a pivotally mounted lever 16 that operates on one end 17 of a range spring 18. The other end of the range spring 18 operates on another pivotally mounted lever 19 which carries an actuator 20 that has a pair of opposed kicker parts 21 and 22 respectively for operating on a movable switch blade 23 of the electrical switch construction 12 in a manner hereinafter described.

Figure 5:
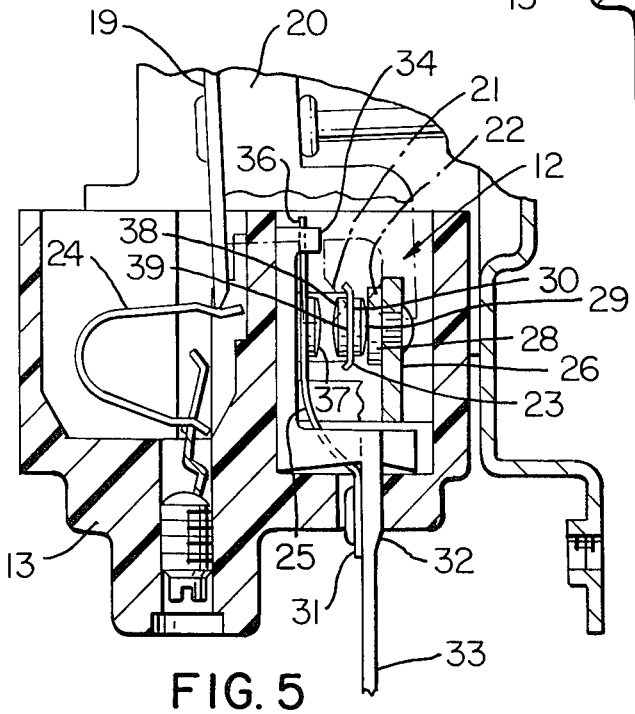
FIG. 5 is a fragmentary view similar to FIG. 2 and illustrates the electrical switch construction in another operating condition thereof.

The lever 19 is rendered snap-acting by a C-shaped rolling spring 24 whereby when a condition responsive device (not shown) acts on the lever 19 in opposition to the force of the range spring 18 and causes the lever 18 to pivot from the position illustrated in FIG. 2 to the position illustrated in FIG. 5, the lever 19 snaps from the position illustrated in FIG. 2 to the position illustrated in FIG. 5 and has the kicker part 21 thereof act against the movable switch blade 23 to move the same from the position illustrated in FIG. 2 to the position illustrated in FIG. 5. Conversely, when the condition responsive device acting on the lever 19 senses that the condition falls below a certain value thereof, the range spring 18 pivots the lever 19 from the position illustrated in FIG. 5 back to the position illustrated in FIG. 2 with a snap action whereby the other kicker 22 of the actuator 20 acts against the movable switch blade 23 to move the same from the position illustrated in FIG. 5 back to the position illustrated in FIG. 2.

Figure 4:
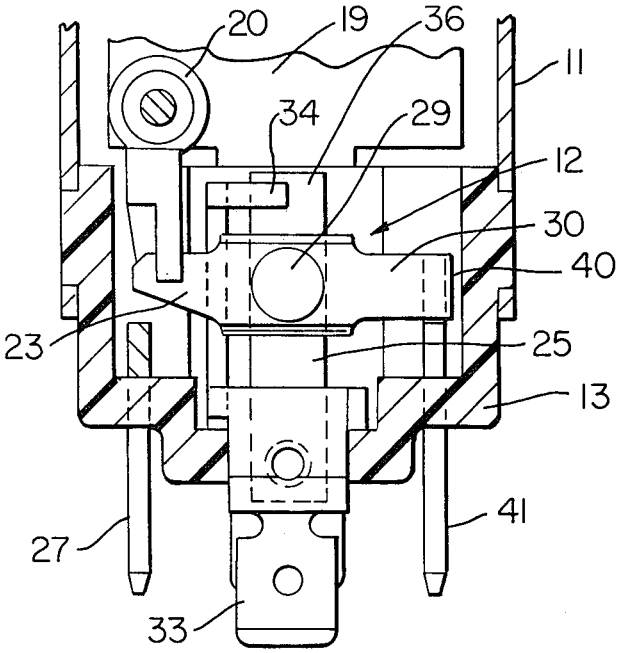
FIG. 4 is a fragmentary cross-sectional view taken on line 4—4 of FIG. 3.

The electrical switch construction 12 of this invention includes a pair of spaced apart fixed switch blades 25 and 26 respectively cooperating with the movable switch blade 23 as will be apparent hereinafter, the fixed switch blade 26 comprising a rigid member having an externally disposed terminal portion 27, FIG. 4, and an electrical contact 28 which cooperates with an electrical contact 29 carried on one side 30 of the movable switch blade 23.

Figure 7:
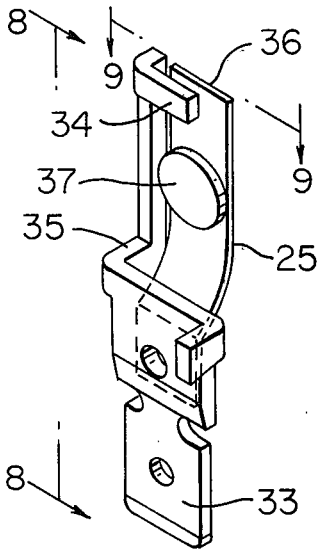
FIG. 7 is a perspective view of the improved overtravel compensating fixed switch blade of this invention that is utilized in the control device of FIGS. 1-6.
Figure 9:
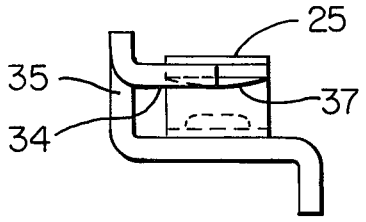
FIG. 9 is an enlarged end view of the switch blade arrangement of FIG. 7 and is taken substantially in the direction of the arrows 9—9 of FIG. 7.
Figure 8:
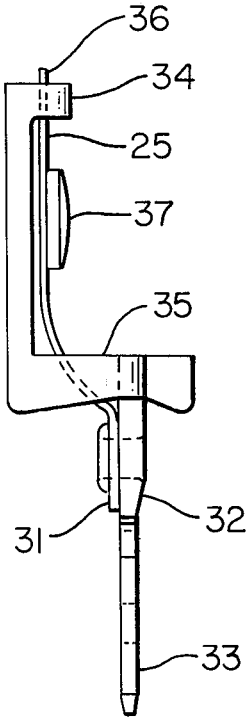
FIG. 8 is an enlarged side view of the switch blade arrangement of FIG. 7 and is taken substantially in the direction of the arrows 8—8 of FIG. 7.
Figure 10:
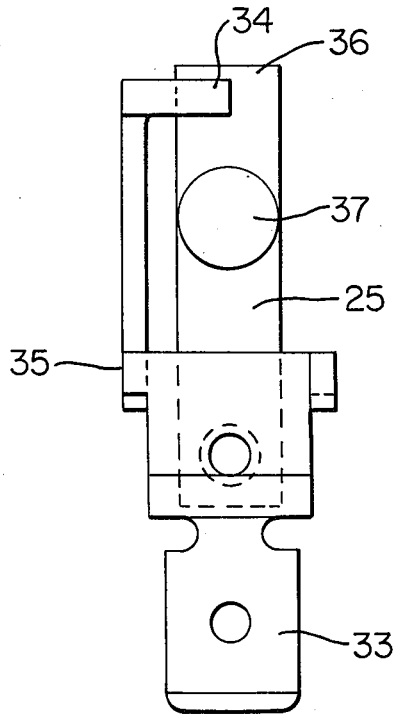
FIG. 10 is an enlarged front view of the switch blade arrangement of FIG. 7.

The other fixed switch blade 25 has one end 31 secured to a first part 32 of a rigid terminal 33 that also projects out of the housing means 13 as illustrated in the drawings, the terminal 33 having an extension 34 held by a side part 35 thereof adjacent the free end 36 of the switch blade 25. The switch blade 25 is bowed between its ends 31 and 36 and has a natural bias to tend to urge the end 35 thereof against the extension 34 of the terminal 33 in the manner illustrated in FIGS. 7, 8, and 9, the extension 34 being offset out of the plane of the first part 32 of the terminal 33 to assure the bowed condition of the switch blade 25.

The overtravel compensating fixed switch blade 25 carries an electrical contact 37 intermediate its ends 31 and 36 as illustrated.

The movable switch blade 23 carries another electrical contact 38 on the side 39 thereof, the contact 38 cooperating with the contact 37 of the switch blade 25 as will be apparent hereinafter. The movable switch blade 23 is L-shaped as illustrated in FIG. 3 so as to have an arm 40 thereof secured to a third terminal 41 which also projects out of the housing 13 in the manner illustrated in FIG. 4.

In this manner, the movable switch blade 23 has a natural bias toward the fixed switch blade 26 whereby it has been found that only the switch blade 25 need be compensated for overtravel of movement of the actuator 20 as will now be apparent.

In particular, the operation of the switch construction 12 of this invention as utilized in the control device 10 will now be described.

Assuming that the switch construction 12 is disposed in the condition illustrated in FIG. 2 wherein the movable switch blade 23 has its contact 38 disposed and held in electrical contact with the contact 37 of the fixed switch blade 25 by the kicker part 22 of the actuator 20 in opposition to the natural bias of switch blade 23, an electrical circuit is completed only between the terminals 33 and 41 as the terminal 27 is out of electrical contact with the movable switch blade 23.

However, should the condition being sensed by the control device 10 increase so as to cause the lever 19 of the control device 10 to pivot from the position illustrated in FIG. 2 to the position illustrated in FIG. 5 in opposition to the force of the range spring 18, the lever 19 through the rolling spring 24 snaps from the position illustrated in FIG. 2 to the position illustrated in FIG. 5 whereby the kicker 21 of the actuator 20 engages against switch blade 23 and rapidly moves the same to the right in the drawings so that the contact 29 thereof will be placed into and held in electrical contact with the fixed contact 28 of the fixed switch blade 26 through the natural bias of the switch blade 23 as illustrated in FIG. 5. Thus, the terminal 41 is now electrically interconnected with the terminal 27 while the terminal 41 is electrically disconnected from the terminal 33 as the contact 38 of the movable switch blade 23 is now out of contact with the contact 37 of the switch blade 25 and the switch blade 25 cannot follow the rightward movement of the movable switch blade 23 as the end 36 of the switch blade 25 is held from such movement of its natural bias by the extension 34 of the terminal 33.

As previously stated, the natural bias of the movable switch blade 23 is to move the same toward the fixed contact 28 but should the contact 38 of the movable switch blade 23 be stuck against the contact 37 of the switch blade 25 when the switch blade 32 is to be moved by the actuator 20 in the above manner, the kicker part 21 of the actuator 20 will kick the movable blade 23 away from the switch blade 25 to overcome any sticking action or weld therebetween when the actuator 20 is snapped by the lever 19 from the position illustrated in FIG. 2 to the position illustrated in FIG. 5.

With the switch construction 12 now in the condition illustrated in FIG. 5, should the condition being sensed by the control device 10 drop so that the range spring 18 pivots the lever 19 from the position illustrated in FIG. 5 back to the position illustrated in FIG. 2, the other kicker 22 of the actuator 20 acts against the switch blade 23 to move the same from the position illustrated in FIG. 5 to the position illustrated in FIG. 2 and thereby place the contact 38 of the movable switch blade 23 back into contact with the contact 37 of the movable blade 25. Also, during such movement of the actuator, if the contacts 29 and 28 should be stuck together, the snap movement of the actuator 20 will cause the kicker 22 to kick the switch blade 23 away from its stuck condition to free its contact 29 from the contact 28.

Figure 6:
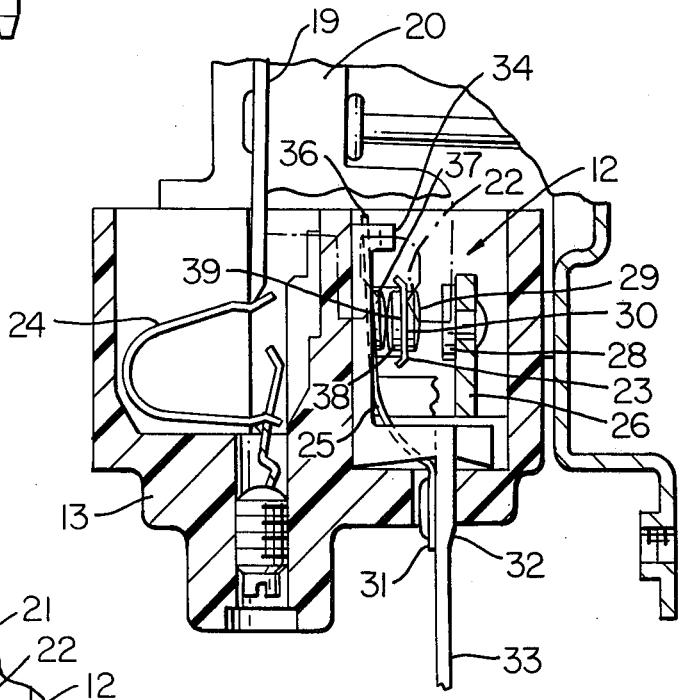
FIG. 6 is a fragmentary view similar to FIG. 2 and illustrates the electrical switch construction in an overtravel condition thereof.

Should the actuator 20 when moving from its position illustrated in FIG. 5 to the position illustrated in FIG. 2 continue to move further to the left in the drawings, such overtravel movement by the actuator 20 is compensated for by the switch blade 25 moving also to the left in the manner illustrated in FIG. 6 as the end 36 of the switch blade 25 can be flexed away from the extension 34 of the terminal 33 to compensate for such overtravel movement of the actuator 20.

In this manner, it can be seen that snap movement of the lever 19 causes the movable switch blade 23 to switch between the positions illustrated in FIGS. 2 and 5 for any desired electrical switching purpose.

Thus, the electrical switch construction 12 of this invention allows either or both sets of terminals 27 and 33 to carry the full amperage at which the switch construction 12 itself is rated whereas some SPDT switch constructions only allow for signal circuit on one set of terminals thereof. Accordingly, the switch construction 12 of this invention can be used in either high cutout or low cutout operations and carry the full electrical load of the device it is controlling.

Accordingly, it can be seen that this invention not only provides an improved switch construction, but also this invention provides an improved overtravel compensating fixed switch blade therefor and a method for making the same.

While the form and method of this invention have been described and illustrated as required by the Patent Statute, it is to be understood that other forms and method steps can be utilized and still fall within the scope of the appended claims.

What is claimed is:

1. In an electrical switch construction having a housing means provided with an actuator for causing movement of a movable switch blade relative to an overtravel compensating fixed switch blade to effect an electrical switching operation, a rigid terminal being carried by said housing means and being secured to said fixed switch blade, said terminal having an extension thereof that is disposed in the path of movement of said fixed switch blade to limit movement of said fixed switch blade to limit movement thereof in one direction, said terminal having a first part thereof that is secured to said fixed switch blade and having a second part thereof that carries said extension thereof, said second part carrying said extension in a position to be out of the plane of said first part thereof, said fixed switch blade having opposed ends and having an electrical contact between said opposed ends thereof, the improvement wherein one of said ends of said fixed switch blade is secured to said first part of said terminal and the other of said ends is engageable with said extension of said terminal only at a point outboard of said contact.

2. In an electrical switch construction as set forth in claim 1, said fixed switch blade being flexible and having a normal bias thereof that tends to move said fixed switch blade against said extension of said terminal.

3. In an electrical switch construction as set forth in claim 2, said movable switch blade being moved into contact with said fixed switch blade by said actuator in a direction opposite to the normal bias of said fixed switch blade whereby overtravel of said fixed switch blade will move the same away from said extension of said terminal.

4. In an electrical switch construction as set forth in claim 1, said fixed switch blade being bowed between said ends thereof.

5. In an electrical switch construction as set forth in claim 1, said second part of said terminal being disposed adjacent one side edge of said fixed switch blade so as to be out of the path of movement thereof.

6. In an electrical switch construction as set forth in claim 1, said housing carrying another fixed switch blade, said movable switch blade being disposed between said fixed switch blades and being respectively cooperable therewith.

7. In an electrical switch construction as set forth in claim 6, said actuator including a double kicker for engaging said movable switch blade respectively on opposite sides thereof to move said movable switch blade from one fixed switch blade to the other fixed switch blade.

8. In an electrical switch construction as set forth in claim 7, said actuator including snap acting means for moving said double kicker with a snap action to snap said movable switch blade between its operating positions.

9. An overtravel fixed switch blade for an electrical switch construction having a housing means provided with an acutator for causing movement of a movable switch blade relative to said overtravel compensating fixed switch blade to effect an electrical switching operation comprising a fixed switch blade, and a rigid terminal adapted to be carried by said housing means and being secured to said fixed switch blade, said terminal having an extension thereof that is disposed in the path of movement of said fixed switch blade to limit movement thereof in one direction, said terminal having a first part thereof that is secured to said fixed switch blade and having a second part thereof that carries said extension thereof, said second part carrying said extension in a position to be out of the plane of said first part thereof, said fixed switch blade having opposed ends and having an electrical contact between said opposed ends thereof, one of said ends being secured to said first part of said terminal and the other of said ends being engageable with said extension of said terminal only at a point outboard of said contact.

10. An overtravel fixed switch blade as set forth in claim 9 wherein said fixed switch blade is flexible and has a normal bias thereof that tends to move said fixed switch blade against said extension of said terminal.

11. An overtravel fixed switch blade as set forth in claim 10 wherein said movable switch blade is adapted to be moved into contact with said fixed switch blade by said actuator in a direction opposite to the normal bias of said fixed switch blade whereby overtravel of said fixed switch blade will move the same away from said extension of said terminal.

12. An overtravel fixed switch blade as set forth in claim 9 wherein said fixed switch blade is bowed between said ends thereof.

13. An overtravel fixed switch blade as set forth in claim 9 wherein said second part of said terminal is disposed adjacent one side edge of said fixed switch blade so as to be out of the path of movement thereof.

14. A method for making an overtravel fixed switch blade for an electrical switch construction having a housing means provided with an actuator for causing movement of a movable switch blade relative to said overtravel compensating fixed switch blade to effect an electrical switching operation comprising the steps of providing a fixed switch blade, providing a rigid terminal adapted to be carried by said housing means, securing said terminal to said fixed switch blade, forming said terminal with an extension thereof that is disposed in the path of movement of said fixed switch blade to limit movement thereof in one direction, forming said terminal to have a first part thereof that is secured to said fixed switch blade and having a second part thereof that carries said extension thereof in a position to be out of the plane of said first part thereof, forming said fixed switch blade with opposed ends and with the contact thereof being located between said opposed ends thereof, and securing one of said ends to said first part of said terminal so that the other of said ends is engageable with said extension of said terminal only at a point outboard of said contact.

15. A method for making an overtravel fixed switch blade as set forth in claim 14 including the step of forming said fixed switch blade to be flexible and have a normal bias thereof that tends to move said fixed switch blade against said extension of said terminals.

16. A method for making an overtravel fixed switch blade as set forth in claim 15 and including the step of forming said fixed switch blade so that said movable switch blade is adapted to be moved into contact with said fixed switch blade by said actuator in a direction opposite to the normal bias of said fixed switch blade whereby overtravel of said fixed switch blade will move the same away from said extension of said terminal.

17. A method for making an overtravel fixed switch blade as set forth in claim 14 and including the step of forming said fixed switch blade to be bowed between said ends thereof.

18. A method for making an overtravel fixed switch blade as set forth in claim 14 and including the step of disposing said second part of said terminal adjacent one side edge of said fixed switch blade so as to be out of the path of movement thereof.

* * * * *